US009944088B2

(12) United States Patent
Oi

(10) Patent No.: US 9,944,088 B2
(45) Date of Patent: Apr. 17, 2018

(54) STATIC ELIMINATOR PERFORMING STATIC ELIMINATION WITH LIGHT AND IMAGE FORMING APPARATUS INCLUDING SAME

(71) Applicant: KYOCERA Document Solutions Inc., Osaka (JP)

(72) Inventor: Hironobu Oi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/598,922

(22) Filed: May 18, 2017

(65) Prior Publication Data

US 2017/0341412 A1 Nov. 30, 2017

(30) Foreign Application Priority Data

May 24, 2016 (JP) ..... 2016-103328

(51) Int. Cl.
*B41J 2/45* (2006.01)
*B41J 11/00* (2006.01)

(52) U.S. Cl.
CPC ..... *B41J 2/451* (2013.01); *B41J 11/002* (2013.01)

(58) Field of Classification Search
CPC ..... B41J 11/002; B41J 13/025; B41J 13/22; B41J 2/17509; B41J 2/41; B41J 2/451; G03G 15/2028; G03G 2215/2032
See application file for complete search history.

(56) References Cited

U.S. PATENT DOCUMENTS 9,052,681 B2 * 6/2015 Nakai ..... G03G 21/06
9,811,047 B2 * 11/2017 Hayamizu ..... G03G 21/06

FOREIGN PATENT DOCUMENTS

JP 2003-295717 A 10/2003

* cited by examiner

*Primary Examiner* — Tracie Y Green
(74) *Attorney, Agent, or Firm* — Stein IP, LLC

(57) ABSTRACT

A static eliminator of the present disclosure includes a light source and a rod-shaped light guide member. The light guide member includes one end surface which light from the light source enters, and emits the light which has entered the one end surface toward an image carrying member. The light guide member includes a reflection portion which reflects light and a light emission surface which emits the light toward the image carrying member. In the one end surface, a concave portion is formed that includes a concave curved surface which is formed in the shape of an arc in a first direction along a direction of light emission extending from the reflection portion toward the image carrying member.

8 Claims, 5 Drawing Sheets

STATIC ELIMINATOR PERFORMING STATIC ELIMINATION WITH LIGHT AND IMAGE FORMING APPARATUS INCLUDING SAME

INCORPORATION BY REFERENCE

This application is based upon and claims the benefit of priority from the corresponding Japanese Patent Application No. 2016-103328 filed on May 24, 2016, the entire contents of which are incorporated herein by reference.

BACKGROUND

The present disclosure relates to a static eliminator and an image forming apparatus that includes such a static eliminator, and more particularly relates to a static eliminator that includes a light source and a light guide member which guides light from the light source so as to emit the light toward an image carrying member and to an image forming apparatus that includes such a static eliminator.

In an image forming apparatus, a charging portion, an exposure portion, a development portion, a transfer portion, a cleaning portion, a static eliminator and the like are provided around an image carrying member. The charging portion uniformly charges the surface of the image carrying member, then the exposure portion performs exposure so as to form an electrostatic latent image on the surface of the image carrying member and furthermore the electrostatic latent image is developed by the development portion. Thereafter, a toner image which is developed is transferred onto a recording medium by the transfer portion, and the recording medium is transported to a fixing portion where the recording medium is fixed and is then ejected to the outside of the apparatus. The toner which is left on the image carrying member at the time of the transfer is removed by the cleaning portion. After the transfer, the static eliminator eliminates charge left on the image carrying member, and the image carrying member is charged again by the charging portion. The residual charge is eliminated before the charging, and thereafter it is possible to uniformly charge the surface of the image carrying member. For the static elimination on the residual charge, the static elimination using light or the like is used.

For example, conventionally, a static eliminator is known that includes an LED lamp (light source), a light entrance portion which light from the LED lamp is made to enter and a rod-shaped light guide (light guide member) which is extended along the axial direction of a photosensitive drum. On a part on the side opposite to the photosensitive drum of the light guide, a reflection portion for reflecting the light from the LED lamp is formed. The light that has entered the light guide travels within the light guide while being diffused, is reflected off the reflection portion to the side of the photosensitive drum and is emitted toward the photosensitive drum.

Incidentally, in the conventional static eliminator described above, the amount of light which is emitted from around the end surface (hereinafter referred to as the one end surface) of the light guide on the side of the LED lamp is larger than the amount of light which is emitted from the other portions of the light guide. It can be considered that the reason why the amount of light which is emitted from around the one end surface of the light guide is larger than the amount of light which is emitted from the other portions of the light guide is the following reason. Specifically, that is because when highly intense and directional light emitted from the LED lamp reaches the reflection portion without being scattered (diffused) on, for example, the surface of the light guide, and is reflected off the reflection portion to the side of the photosensitive drum, the relatively highly intense and directional light reaches the photosensitive drum.

A structure is known in which a large number of minute prisms are formed on the one end surface of the light guide member such that light entering from the one end surface is diffused.

SUMMARY

A static eliminator according to one aspect of the present disclosure performs static elimination on an image carrying member. The static eliminator includes a light source and a rod-shaped light guide member. The light source emits light. The light guide member includes one end surface which the light from the light source enters, is extended along the axial direction of the image carrying member, guides, along the axial direction of the image carrying member, the light which has entered the one end surface and emits the light toward the image carrying member. The light guide member includes a reflection portion and a light emission surface. The reflection portion is provided on a surface on a side opposite to the image carrying member so as to be extended in the axial direction and reflects the light which has entered the one end surface. The light emission surface is provided on the side of the image carrying member and emits the light reflected off the reflection portion toward the image carrying member. In the one end surface, a concave portion is formed that includes a concave curved surface which is formed in a shape of an arc in a first direction along a direction of light emission extending from the reflection portion toward the image carrying member.

Further other objects of the present disclosure and specific advantages obtained by the present disclosure will become more apparent from the description of an embodiment given below.

DETAILED DESCRIPTION

An embodiment of the present disclosure will be described below with reference to drawings.

Figure 1:
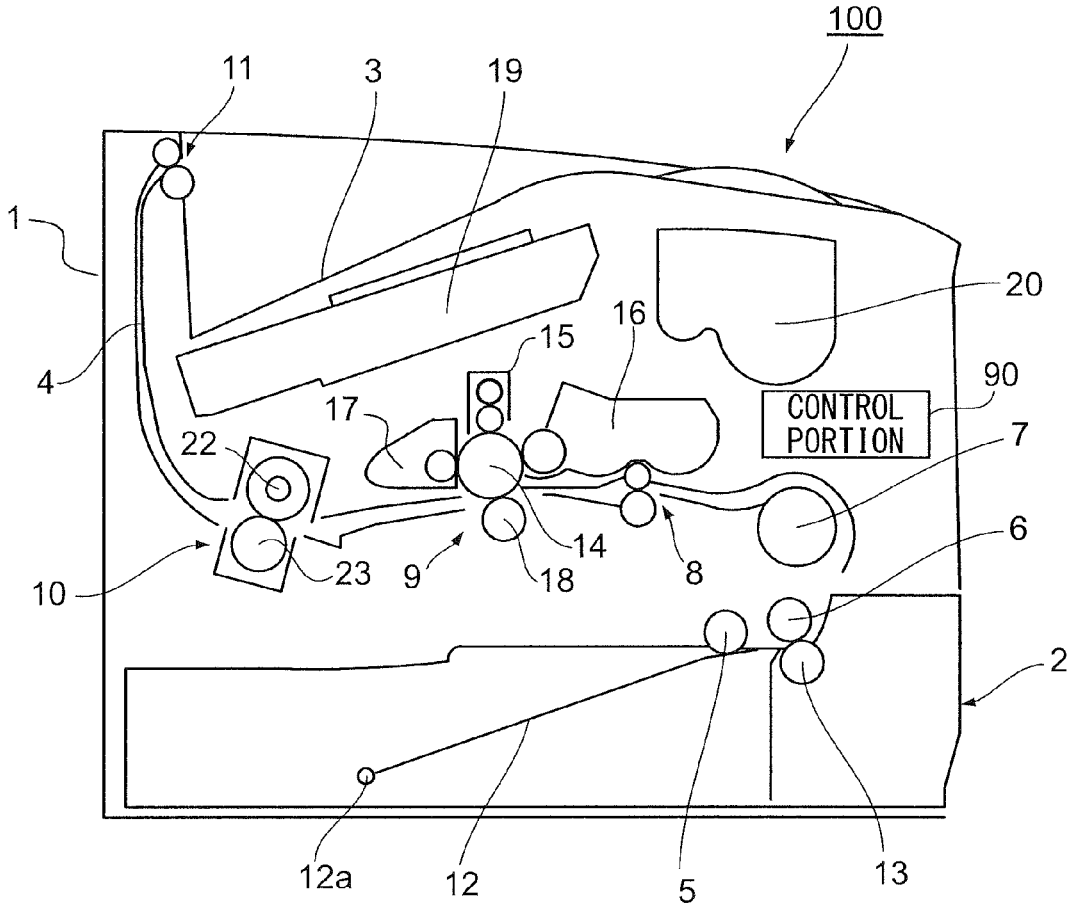
FIG. 1 is a cross-sectional view showing the structure of an image forming apparatus that includes a static eliminator according to an embodiment of the present disclosure.

An image forming apparatus 100 that includes a static eliminator 30 according to the embodiment of the present disclosure will be described with reference to FIGS. 1 to 7. As shown in FIG. 1, in the image forming apparatus 100 (here, a monochrome printer), a paper feed cassette 2 is provided which stores sheets (recording media) loaded in a lower portion of the apparatus main body 1. FIG. 1 is shown on the assumption that the right side is the front side of the image forming apparatus 100. Above the paper feed cassette 2, a sheet transport path 4 is formed which is extended from the front of the apparatus main body 1 to the back substantially horizontally, which is further extended upward and which leads to a paper ejection portion 3 formed in the upper surface of the apparatus main body 1. Along the sheet transport path 4, sequentially from the upstream side, a pickup roller 5, a feed roller 6, an intermediate transport roller 7, a registration roller pair 8, an image formation portion 9, a fixing device 10 and an ejection roller pair 11 are arranged. Furthermore, within the image forming apparatus 100, a control portion 90 is arranged which controls the operations of the rollers, the image formation portion 9, the fixing device 10 and the like described above.

In the paper feed cassette 2, a sheet loading plate 12 is provided which is supported by a turning pivot 12*a* provided at a back end portion in a sheet transport direction such that the sheet loading plate 12 can be turned with respect to the paper feed cassette 2, and sheets loaded on the sheet loading plate 12 are pressed by the pickup roller 5. In this configuration, in the front side of the paper feed cassette 2, a retard roller 13 is arranged so as to be pressed onto the feed roller 6, and when a plurality of sheets are simultaneously fed with the pickup roller 5, the sheets are separated by the feed roller 6 and the retard roller 13 such that only the uppermost sheet is transported.

Then, for the sheet separated by the feed roller 6 and the retard roller 13, the transport direction is changed by the intermediate transport roller 7 toward the back of the apparatus, and the sheet is transported to the registration roller pair 8 and is supplied to the image formation portion 9 with timing which is adjusted by the registration roller pair 8.

The image formation portion 9 uses an electrophotographic process to form a predetermined toner image on the sheet, and is formed with a photosensitive drum 14 that is an image carrying member which is rotatably supported with a shaft in a clockwise direction in FIG. 1 and a charging device 15, a development device 16, a cleaning device 17, a transfer roller (transfer member) 18 that is arranged opposite the photosensitive drum 14 through the sheet transport path 4, an exposure device (LSU) 19 that is arranged above the photosensitive drum 14 and a static eliminator 30 (see FIG. 2), which are arranged around the photosensitive drum 14. Above the development device 16, a toner container 20 is arranged that supplies a toner to the development device 16.

Figure 3:
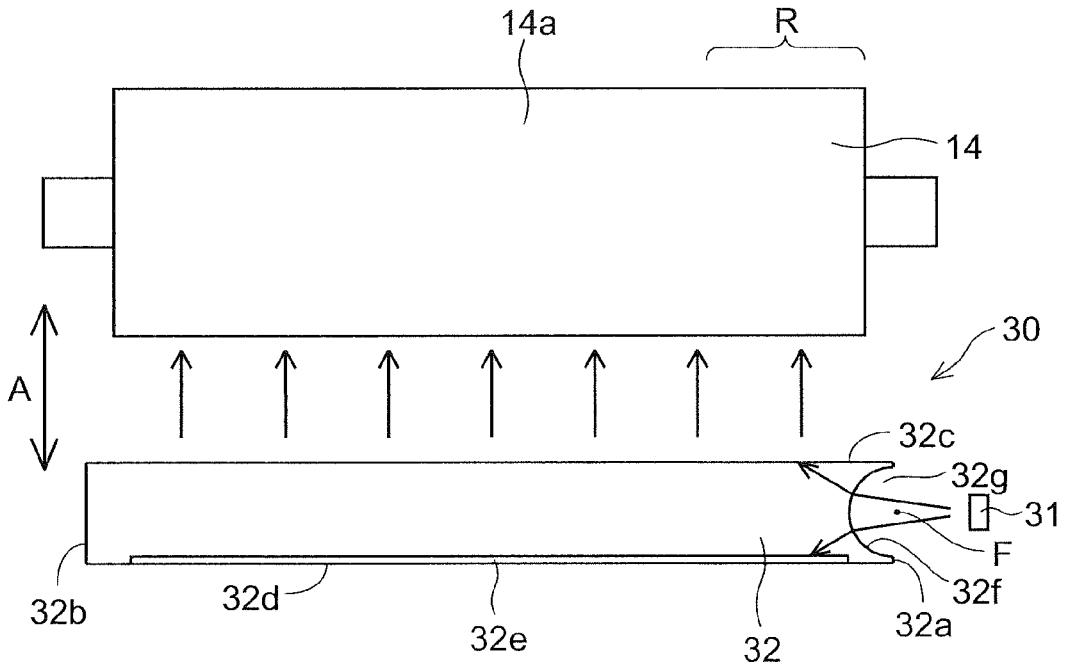
FIG. 3 is a diagram showing the structure of the static eliminator and a photosensitive drum according to the embodiment of the present disclosure.

The photosensitive drum 14 is formed by stacking a photosensitive layer 14*a* of amorphous silicon on the outer circumferential surface of a conductive substrate (cylindrical member) of aluminum or the like. In a new photosensitive drum 14, as shown in FIG. 3, the thickness (for example, 31 to 32 μm) of a predetermined region R of the photosensitive layer 14*a* on the side of a light source 31 which will be described later is about 1 to 2 μm larger than the thickness (for example, 30 μm) of the other regions of the photosensitive layer 14*a*. The predetermined region R is a region that is extended inward, for example, 50 mm from the end portion of the photosensitive layer 14*a* on the side of the light source 31.

Figure 2:
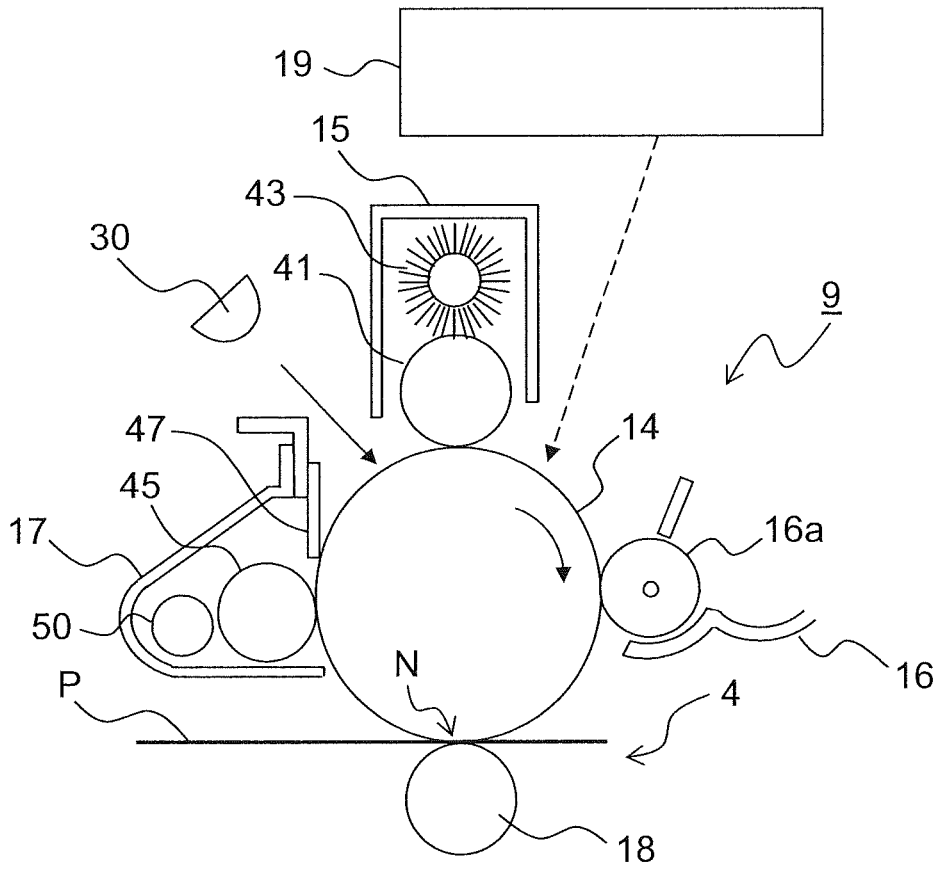
FIG. 2 is a partially enlarged view of an image formation portion in FIG. 1.

As shown in FIG. 2, the charging device 15 includes, within a charging housing, a charging roller 41 that makes contact with the photosensitive drum 14 so as to apply a charging bias to the surface of the drum and a charging roller cleaning brush 43 for cleaning the charging roller 41. The charging roller 41 is formed of a conductive rubber, and is arranged so as to make contact with the photosensitive drum 14.

When the photosensitive drum 14 is rotated in the clockwise direction in FIG. 2, the charging roller 41 in contact with the surface of the photosensitive drum 14 is drive to rotate in a counterclockwise direction in FIG. 2. Here, a predetermined voltage is applied to the charging roller 41, and thus the surface of the photosensitive drum 14 is uniformly charged. As the charging roller 41 is rotated, the charging roller cleaning brush 43 in contact with the charging roller 41 is driven to rotate in the clockwise direction in FIG. 2, with the result that a foreign substance adhered to the surface of the charging roller 41 is removed.

The development device 16 supplies the toner to an electrostatic latent image that is formed on the photosensitive drum 14 with a development roller 16*a*. The supply of the toner to the development device 16 is performed from the toner container 20 (see FIG. 1) through an intermediate hopper (not shown).

The transfer roller 18 is arranged on the downstream side of the development device 16 in the direction of rotation of the photosensitive drum 14 so as to make contact with the photosensitive drum 14, and thus a transfer nip portion N is formed. The toner image formed on the surface of the photosensitive drum 14 is transferred onto the sheet P when the sheet P transported along the sheet transport path 4 is passed through the transfer nip portion N.

The cleaning device 17 includes a rubbing roller 45, a cleaning blade 47 and a toner collection roller 50. The rubbing roller 45 is pressed onto the photosensitive drum 14 with a predetermined pressure and is driven with a drum cleaning motor (not shown) to rotate on the contact surface with the photosensitive drum 14 in the same direction, and thus the toner left on the surface of the photosensitive drum 14 is removed and the photosensitive layer on the surface of the photosensitive drum 14 is rubbed and polished with the residual toner. The toner supplied from the development device 16 is a toner (abrasive toner) which contains an abrasive material. The abrasive toner is used not only for adhering to the electrostatic latent image on the photosensitive drum 14 so as to form the toner image but also for polishing the surface of the photosensitive drum 14 by utilization of the residual toner which is not transferred with the transfer roller 18.

On the downstream side of the surface of the photosensitive drum 14 in the rotation direction with respect to the contact surface with the rubbing roller 45, the cleaning blade 47 is fixed in a state where the cleaning blade 47 is in contact with the photosensitive drum 14. The toner collection roller 50 is rotated reversely with respect to the rubbing roller 45 while being in contact with the surface of the rubbing roller 45, and thus the toner and the like adhered to the rubbing roller 45 are collected.

The static eliminator 30 is arranged on the downstream side of the cleaning device 17 and on the upstream side of the charging device 15 in the direction of rotation of the photosensitive drum 14. The static eliminator 30 applies static elimination light to the photosensitive drum 14 so as to eliminate charge left on the surface of the photosensitive drum 14 to a predetermined potential or less. The detailed structure of the static eliminator 30 will be described later.

When image data is input from a higher device such as a personal computer, the charging device 15 first uniformly charges the surface of the photosensitive drum 14. Then, with a laser beam from the exposure device (LSU) 19, an electrostatic latent image based on the image data input is formed on the photosensitive drum 14. Furthermore, the development device 16 adheres the toner to the electrostatic latent image so as to form the toner image on the surface of the photosensitive drum 14.

The toner image formed on the surface of the photosensitive drum 14 is transferred with the transfer roller 18 to the sheet P supplied to the nip portion (transfer nip portion N) between the photosensitive drum 14 and the transfer roller 18. The sheet P to which the toner image is transferred is separated from the photosensitive drum 14 and is transported toward the fixing device 10. The fixing device 10 is arranged on the downstream side of the image formation portion 9 in the sheet transport direction, the sheet P to which the toner image is transferred in the image formation portion 9 is heated and pressurized with a heating roller 22 and a pressure roller 23 pressed onto the heating roller 22 that are included in the fixing device 10 and thus the toner image transferred to the sheet P is fixed. Then, the sheet P in which the image is formed in the image formation portion 9 and the fixing device 10 is ejected with the ejection roller pair 11 to the paper ejection portion 3.

The detailed structure of the static eliminator 30 will then be described. As shown in FIG. 3, the static eliminator 30 is formed with the light source 31 that emits the static elimination light and a rod-shaped light guide member 32 that is extended along the axial direction of the photosensitive drum 14.

The light source 31 is formed with a light-emitting diode (LED) or the like that emits the static elimination light, and is mounted on an unillustrated light source substrate.

Figure 4:
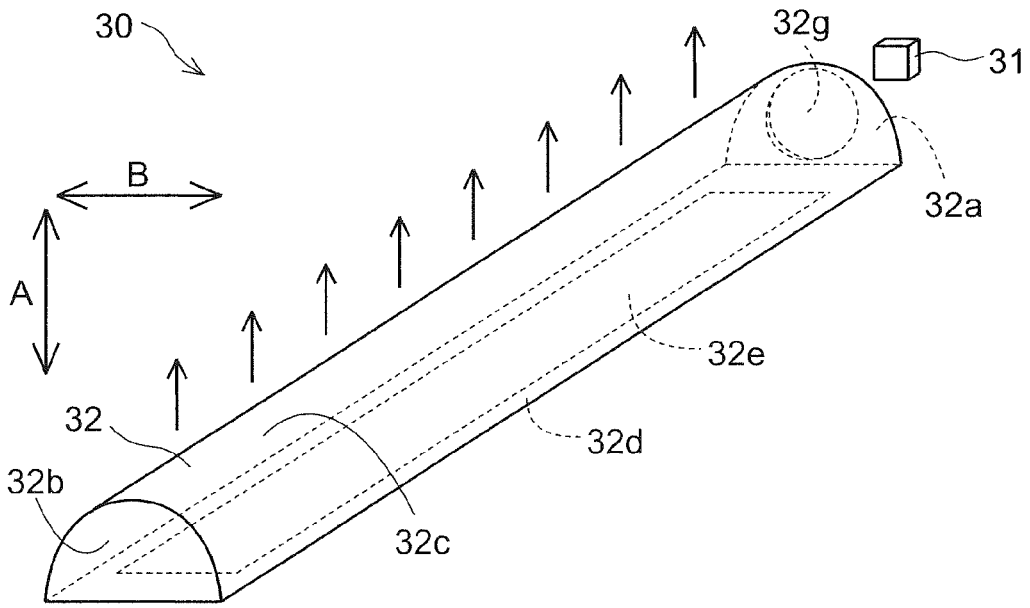
FIG. 4 is a perspective view showing, from the side of a light emission surface, the structure of the static eliminator according to the embodiment of the present disclosure.
Figure 5:
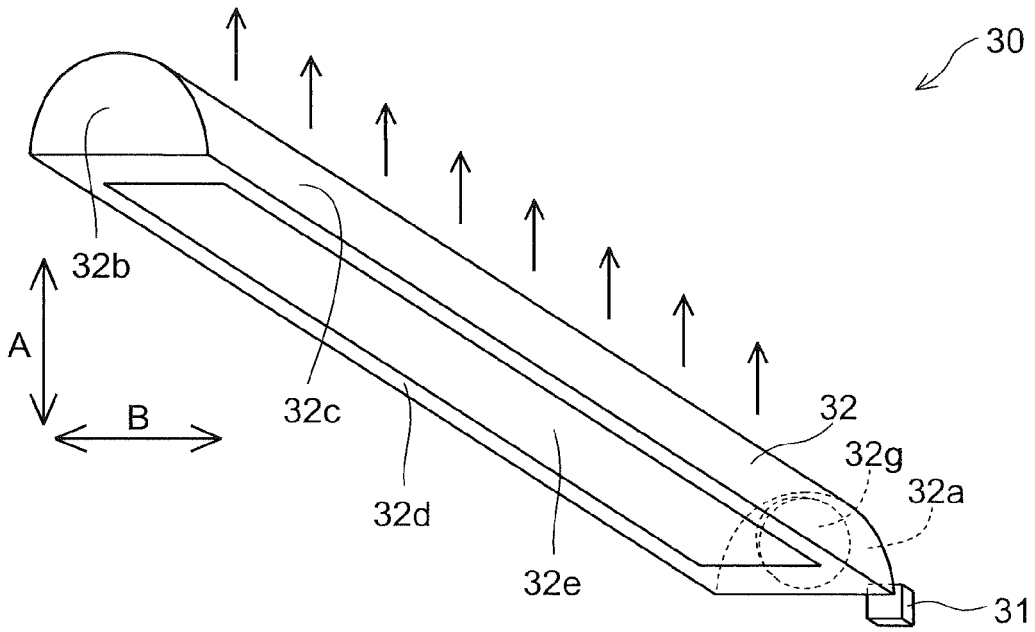
FIG. 5 is a perspective view showing, from the side of a back surface, the structure of the static eliminator according to the embodiment of the present disclosure.

As shown in FIGS. 4 and 5, the light guide member 32 is formed in an elongated shape having a substantially semicircular cross section, and is formed by injection-molding a translucent resin with a mold. The light guide member 32 emits the light from the light source 31 toward the photosensitive drum 14 while guiding the light along the direction (the axial direction of the photosensitive drum 14) in which the light guide member 32 is extended.

The light guide member 32 includes: one end surface 32*a* that is a light entrance surface which is arranged opposite the light source 31 and which the light from the light source 31 enters; the other end surface 32*b* which is arranged on the side opposite to the light source 31; a light emission surface 32*c* which is arranged between the one end surface 32*a* and the other end surface 32*b*, which is arranged opposite the photosensitive drum 14 and whose cross section is formed in the shape of an arc; and a back surface 32*d* which is arranged between the one end surface 32*a* and the other end surface 32*b* and which is arranged on the side opposite to the photosensitive drum 14.

In a region of the back surface 32*d* other than an edge portion, a reflection portion 32*e* that reflects the light which has entered the light guide member 32 to the side of the photosensitive drum 14 (the side of the light emission surface 32*c*) is formed so as to be extended in the axial direction of the photosensitive drum 14. In the reflection portion 32*e*, a plurality of prisms (not shown) are formed which consist of, for example, V-shaped grooves that are extended in a direction (vertical direction with respect to the plane of FIG. 3) intersecting the axial direction of the photosensitive drum 14.

The light that is emitted from the light source 31 and that enters the one end surface 32*a* of the light guide member 32 travels within the light guide member 32 while being diffused, is reflected off the reflection portion 32*e* to the side of the light emission surface 32*c* and is emitted from the light emission surface 32*c* toward the photosensitive drum 14.

Here, in the present embodiment, in the one end surface 32*a*, a concave portion 32*g* that has a concave curved surface 32*f* is formed opposite the light source 31. When it is assumed that a direction along the direction of light emission extending from the reflection portion 32*e* toward the photosensitive drum 14 is an arrow A direction (first direction) and that a direction perpendicular to the axial direction of the photosensitive drum 14 and the arrow A direction is an arrow B direction (second direction), the concave curved surface 32*f* is formed in the shape of an arc in the arrow A direction and the arrow B direction, and for example, is formed in the shape of a hemispherical surface. As shown in FIG. 3, the length of the concave curved surface 32*f* in the arrow A direction is longer than that of the light source 31 in the arrow A direction.

The concave curved surface 32*f* has a focal point F (see FIG. 3) that is determined by the material of the light guide member 32 and the shape of the concave curved surface 32*f*, and the light source 31 is arranged in a position that is farther from the concave curved surface 32*f* than the focal point F.

Figure 6:
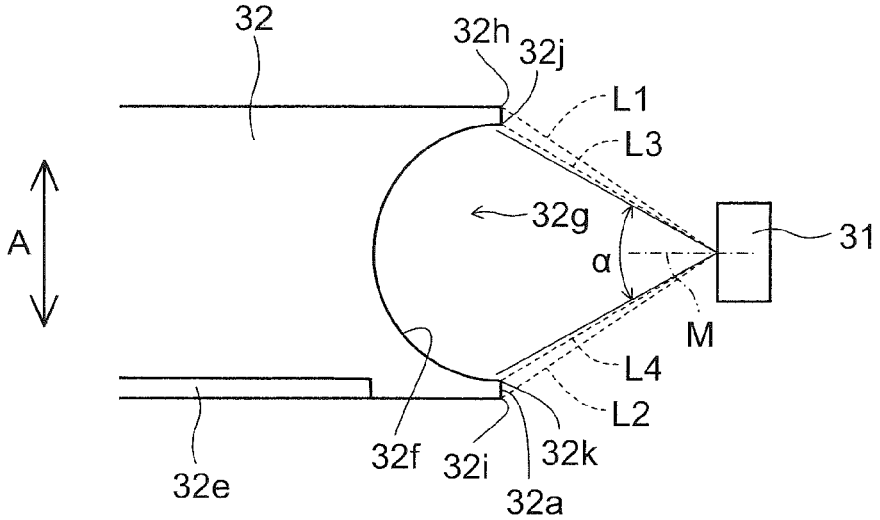
FIG. 6 is a cross-sectional view showing the structure of a light guide member of the static eliminator in the vicinity of a light entrance surface according to the embodiment of the present disclosure.
Figure 7:
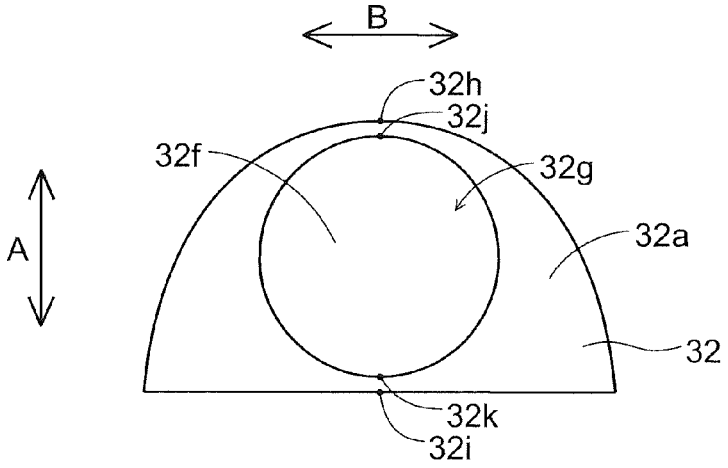
FIG. 7 is a diagram showing the structure of the light entrance surface of the light guide member of the static eliminator according to the embodiment of the present disclosure.

As shown in FIG. 6, the directivity angle (angle at which the intensity of light is 50% of a peak value) a of the light source 31 is equal to or less than an angle that is formed by two straight lines L1 and L2 which connect both end portions (end portions 32*h* and 32*i* (also see FIG. 7)) of the one end surface 32*a* in the arrow A direction and the light source 31. The light source 31 is arranged in such a position that all light emitted from the range of the directivity angle with the optical axis M of the light source 31 in its center reaches the one end surface 32*a*.

Preferably, the directivity angle $\alpha$ of the light source 31 is equal to or less than an angle that is formed by two straight lines L3 and L4 which connect both end portions (end portions 32*j* and 32*k* (also see FIG. 7)) of the concave curved surface 32*f* in the arrow A direction and the light source 31. The light source 31 is arranged in such a position that all light emitted from the range of the directivity angle with the optical axis M of the light source 31 in its center reaches the concave curved surface 32*f*.

In the present embodiment, as described above, in the one end surface 32*a* of the light guide member 32, the concave portion 32*g* is formed that has the concave curved surface 32*f* in the shape of an arc in the arrow A direction along the direction of the light emission extending from the reflection portion 32*e* toward the photosensitive drum 14. In this way, the highly intense and directional light emitted from the light source 31 can be scattered (diffused) with the concave curved surface 32*f* when the light enters the one end surface 32*a* of the light guide member 32, and thus it is possible to reduce the arrival of the relatively highly intense and directional light at the photosensitive drum 14. Hence, it is possible to reduce unnecessary local static elimination on the end portion (the predetermined region R) of the photosensitive drum 14 on the side of the light source 31, with the result that it is possible to reduce the degradation of the image.

Unlike a case where as in a conventional structure, prisms are formed on the one end surface of the light guide member, it is not necessary to form a large number of minute prisms, and thus it is possible to scatter (diffuse) the light with the one concave curved surface 32*f*. Hence, it is possible to reduce the degree of complexity of the structure of the mold for forming the light guide member 32.

It is not necessary to extend the side of the one end surface 32*a* of the light guide member 32 so that the arrival of the relatively highly intense and directional light at the photosensitive drum 14 is reduced, and thus it is possible to reduce the increase in the size of the light guide member 32 and the static eliminator 30.

As described above, the light source 31 is arranged in the position that is farther from the concave curved surface 32*f* than the focal point F. In this way, it is possible to more scatter (diffuse) the light that is emitted from the light source 31 and that enters the concave curved surface 32*f*.

As described above, the directivity angle α of the light source 31 is equal to or less than the angle that is formed by the two straight lines L1 and L2 which connect both the end portions (end portions 32*h* and 32*i*) of the one end surface 32*a* in the arrow A direction and the light source 31. In this way, it is possible to make all light emitted from the range of the directivity angle with the optical axis M of the light source 31 in its center reach the one end surface 32*a*, and thus it is possible to easily reduce the decrease in the efficiency of utilization of the light.

As described above, the directivity angle α of the light source 31 is equal to or less than the angle that is formed by the two straight lines L3 and L4 which connect both the end portions (end portions 32*j* and 32*k*) of the concave curved surface 32*f* in the arrow A direction and the light source 31. In this way, it is possible to make all light emitted from the range of the directivity angle with the optical axis M of the light source 31 in its center reach the concave curved surface 32*f*, and thus it is possible to scatter (diffuse) a larger amount of light. Hence, it is possible to effectively reduce the arrival of the relatively highly intense and directional light at the photosensitive drum 14.

As described above, the concave curved surface 32*f* is also formed in the shape of an arc in the arrow B direction. In this way, the highly intense and directional light emitted from the light source 31 can also be scattered (diffused) with the concave curved surface 32*f* in the arrow B direction, and thus it is possible to effectively reduce the arrival of the relatively highly intense and directional light at the photosensitive drum 14.

As described above, the length of the concave curved surface 32*f* in the arrow A direction is longer than that of the light source 31 in the arrow A direction. In this way, it is possible to easily scatter (diffuse), with the concave curved surface 32*f*, a larger amount of light emitted from the light source 31, and thus it is possible to easily reduce the arrival of the relatively highly intense and directional light at the photosensitive drum 14.

As described above, the thickness of the predetermined region R of the photosensitive layer 14*a* on the side of the light source 31 is larger than the thickness of the other regions of the photosensitive layer 14*a*. Even when the concave curved surface 32*f* is formed in the one end surface 32*a* of the light guide member 32, the light that reaches the photosensitive drum 14 is not completely uniform. Hence, in the predetermined region R of the photosensitive layer 14*a* on the side of the light source 31, the amount of static elimination light is relatively larger than in the other regions, and thus the potential when the static elimination is performed is easily lowered, with the result that the photosensitive layer is easily cut away. Therefore, when the apparatus is used for a long period of time, only the predetermined region R is reduced in thickness as compared with the other regions (the film thickness difference is increased), and thus the image quality is changed. Hence, in a new photosensitive drum 14, the thickness of the predetermined region R of the photosensitive layer 14*a* is made larger than the thickness of the other regions of the photosensitive layer 14*a*, and thus it is possible to delay the time when the film thickness difference in the photosensitive layer 14*a* is increased. In other words, it is possible to extend the period during which the image quality is satisfactory.

It should be considered that the embodiment disclosed herein is illustrative in all respects and not restrictive. The scope of the present disclosure is indicated not by the description of the embodiment discussed above but by the scope of claims, and furthermore, meanings equivalent to the scope of claims and all modifications within the scope are included.

For example, although the example where the present disclosure is applied to the monochrome printer is described, the present disclosure is not limited to this example. It is needless to say that the present disclosure may be applied to other image forming apparatuses such as a color printer, a monochrome copying machine, a digital copying machine and a facsilline machine.

Although in the embodiment discussed above, the example where the light guide member 32 is formed so as to have a substantially semicircular cross section is described, the present disclosure is not limited to this example. For example, the light guide member 32 may be formed so as to have a substantially circular cross section or a rectangular cross section.

Although in the embodiment discussed above, the example where the concave curved surface 32*f* is formed in the shape of a hemispherical surface, that is, an arc in the arrow A direction and the arrow B direction is described, the present disclosure is not limited to this example, and the concave curved surface 32*f* may be formed in a cylindrical shape, that is, in the shape of an arc only in the arrow A direction.

Although in the embodiment discussed above, the example where the photosensitive layer 14*a* of the photosensitive drum 14 is formed of amorphous silicon is described, the photosensitive layer 14*a* may be formed with an organic photosensitive member (OPC photosensitive member).

What is claimed is:

1. A static eliminator that performs static elimination on an image carrying member, the static eliminator comprising:

a light source that emits light; and a rod-shaped light guide member that includes one end surface which the light from the light source enters, that is extended along an axial direction of the image carrying member, that guides, along the axial direction of the image carrying member, the light which has entered the one end surface and that emits the light toward the image carrying member, wherein the light guide member includes a reflection portion that is provided on a surface on a side opposite to the image carrying member so as to be extended in the axial direction and that reflects the light which has entered the one end surface and a light emission surface that is provided on a side of the image carrying member and that emits the light reflected off the reflection portion toward the image carrying member, and in the one end surface, a concave portion is formed that includes a concave curved surface which is formed in a shape of an arc in a first direction along a direction of light emission extending from the reflection portion toward the image carrying member.

2. The static eliminator according to claim 1, wherein the concave curved surface is formed so as to have a focal point, and the light source is arranged in a position that is farther from the concave curved surface than the focal point.

3. The static eliminator according to claim 1, wherein a directivity angle of the light source is equal to or less than an angle that is formed by two straight lines which connect both end portions of the one end surface in the first direction and the light source.

4. The static eliminator according to claim 3, wherein the directivity angle of the light source is equal to or less than an angle that is formed by two straight lines which connect both end portions of the concave curved surface in the first direction and the light source.

5. The static eliminator according to claim 1, wherein the concave curved surface is also formed in a shape of an arc in a second direction that is perpendicular to both the axial direction and the first direction.

6. The static eliminator according to claim 1, wherein a length of the concave curved surface in the first direction is longer than a length of the light source in the first direction.

7. An image forming apparatus comprising:

the static eliminator according to claim 1; and the image carrying member whose surface is subjected to static elimination performed by the static eliminator.

8. The image forming apparatus according to claim 7, wherein a photosensitive layer is provided on the surface of the image carrying member, and a thickness of a predetermined region of the photosensitive layer on a side of the light source is smaller than a thickness of other regions of the photosensitive layer.

* * * * *